US009670747B2

(12) United States Patent
Ruffo

(10) Patent No.: US 9,670,747 B2
(45) Date of Patent: Jun. 6, 2017

(54) ANNULUS SEALING ARRANGEMENT AND METHOD OF SEALING AN ANNULUS

(71) Applicant: Antonio C. Ruffo, Cypress, TX (US)

(72) Inventor: Antonio C. Ruffo, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 340 days.

(21) Appl. No.: 14/562,906

(22) Filed: Dec. 8, 2014

(65) Prior Publication Data

US 2016/0160602 A1 Jun. 9, 2016

(51) Int. Cl.
*E21B 33/12* (2006.01)

(52) U.S. Cl.
CPC ..... *E21B 33/1216* (2013.01); *E21B 33/1208* (2013.01)

(58) Field of Classification Search
CPC ..... E21B 33/1208; E21B 33/1216
See application file for complete search history.

(56) References Cited

U.S. PATENT DOCUMENTS

| | | | | |
|---|---|---|---|---|
| 49,599 | A | 8/1865 | Sicouret | |
| 1,301,285 | A | 4/1919 | Leondard | |
| 2,136,597 | A | 11/1938 | Spang | |
| 2,165,687 | A | 7/1939 | Thaheld | |
| 2,196,668 | A | 4/1940 | Ragan | |
| 2,430,623 | A | 11/1947 | Taylor, Jr. et al. | |
| 4,403,660 | A | 9/1983 | Coone | |
| 4,665,978 | A * | 5/1987 | Luke | E21B 33/1208 166/196 |
| 7,422,071 | B2 | 9/2008 | Wilkie et al. | |
| 7,921,921 | B2 | 4/2011 | Bishop et al. | |
| 8,191,625 | B2 | 6/2012 | Porter et al. | |
| 2009/0255690 | A1 * | 10/2009 | Conner | E21B 33/1216 166/387 |
| 2013/0213672 | A1 * | 8/2013 | Nutley | E21B 17/10 166/382 |

FOREIGN PATENT DOCUMENTS

| | | | |
|---|---|---|---|
| GB | 2435486 | A | 8/2007 |
| WO | 2009074785 | A2 | 6/2009 |

* cited by examiner

*Primary Examiner* — George Gray
(74) *Attorney, Agent, or Firm* — Cantor Colburn LLP

(57) ABSTRACT

An annulus sealing arrangement includes, at least one member positionable within an annulus, a first radial dimension of the at least one member is initially less than a second radial dimension defined by the annulus, and a plurality of plates in operable communication with the at least one member initially positioned with surfaces of the plurality of plates forming acute angles relative to an axis defined by the annulus, at least a first portion of each of the plurality of plates perimetrically overlapping a second portion of at least one other of the plurality of plates positioned perimetrically adjacent thereto, the annulus sealing arrangement is configured such that increases in the first radial dimension cause the acute angles to increase.

23 Claims, 3 Drawing Sheets

ANNULUS SEALING ARRANGEMENT AND METHOD OF SEALING AN ANNULUS

BACKGROUND

Sealing annular spaces to fluidic flow is a common need in several industries. Many devices exist to create such seals and most serve the purpose for which they were created quite well. Those who practice in such industries however, are always interested in new systems and methods for creating such seals.

BRIEF DESCRIPTION

Disclosed herein is an annulus sealing arrangement. The arrangement includes, at least one member positionable within an annulus, a first radial dimension of the at least one member is initially less than a second radial dimension defined by the annulus, and a plurality of plates in operable communication with the at least one member initially positioned with surfaces of the plurality of plates forming acute angles relative to an axis defined by the annulus, at least a first portion of each of the plurality of plates perimetrically overlapping a second portion of at least one other of the plurality of plates positioned perimetrically adjacent thereto, the annulus sealing arrangement is configured such that increases in the first radial dimension cause the acute angles to increase.

Further disclosed herein is a method of sealing an annulus. The method includes, radially increasing a dimension of a member to span a radial dimension of the annulus, sealing the annulus to flow past the member, rotating a plurality of plates in operable communication with the member with the radial increasing of the member, preventing the plurality of plates from moving longitudinally away from the member, and preventing extrusion of the member through the annulus past the plurality of plates.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
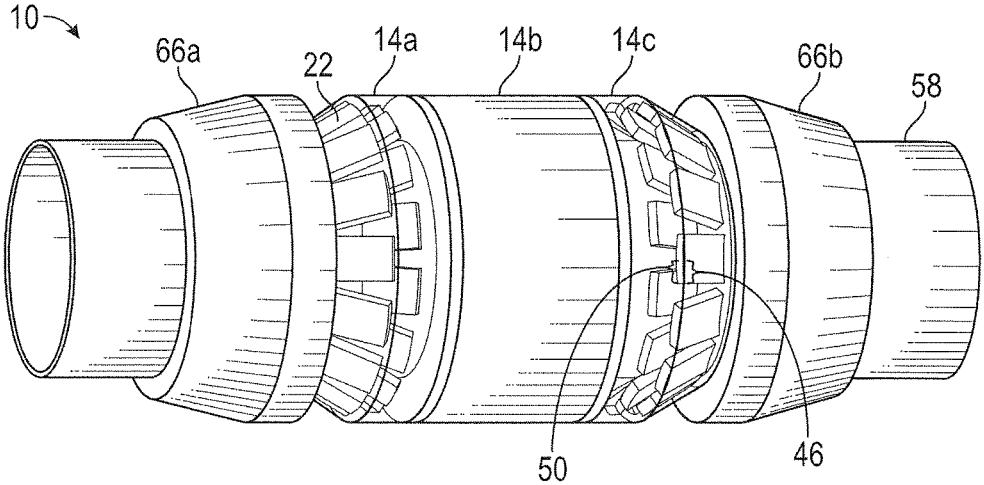
FIG. 1 depicts a perspective view of an annulus sealing arrangement disclosed herein in an unsealed position.

A detailed description of one or more embodiments of the disclosed apparatus and method are presented herein by way of exemplification and not limitation with reference to the Figures.

Referring to FIGS. 1 through 5, an annulus sealing arrangement disclosed herein is illustrated at 10. The annulus sealing arrangement 10 includes, at least one member 14A, 14B, 14C, illustrated in this embodiment as a polymer, positionable within an annulus 18, with three of the polymers 14A, 14B, 14C being shown in one embodiment even though a single one of the polymers 14A, 14B, 14C is also contemplated, and a plurality of plates 22 in operable communication with the three polymers 14A, 14B and 14C. First radial dimensions 26 of the polymers 14A, 14B, 14C are initially less than a second radial dimension 30 defined by the annulus 18. The plates 22 are initially positioned with surfaces 34 of the plurality of plates 22 forming acute angles 38 relative to an axis 42 defined by the annulus 18. At least a first portion 46 of each of the plates 22 in one row of the plates 22 perimetrically overlaps with a second portion 50 (best seen in FIGS. 1 and 5) of at least one other of the plates 22 in another row of the plates 22 positioned perimetrically adjacent thereto. The annulus sealing arrangement 10 is configured such that increases in the first annular dimension 26 cause the acute angles 38 to increase.

Figure 2:
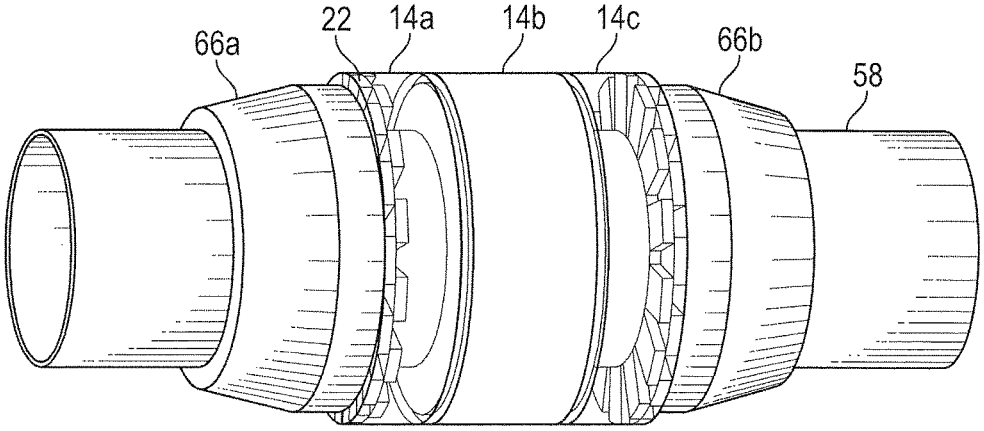
FIG. 2 depicts a perspective view of the annulus sealing arrangement of FIG. 1 in a sealed position.
Figure 3:
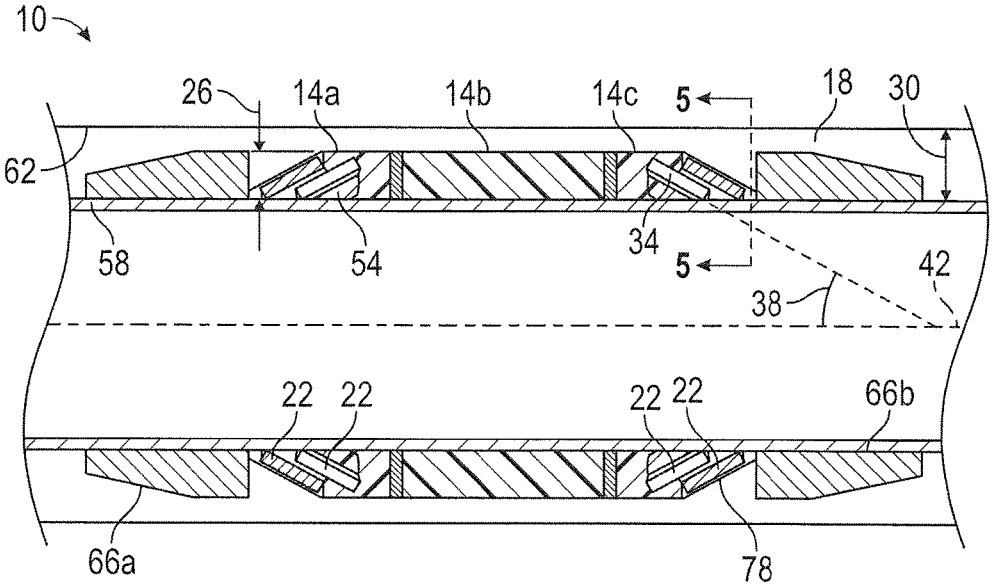
FIG. 3 depicts a cross sectional view of the annulus sealing arrangement of FIG. 1 in an unsealed position.
Figure 4:
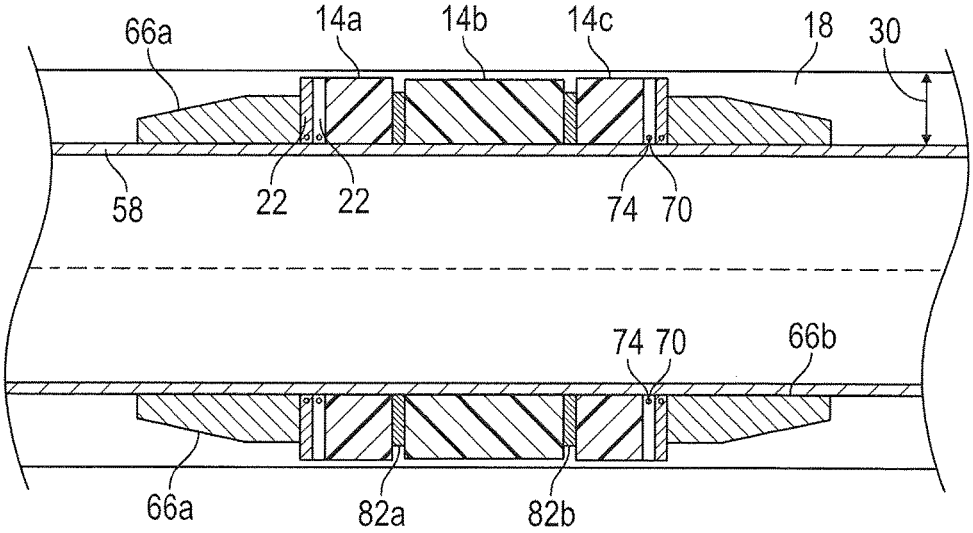
FIG. 4 depicts a cross sectional view of the annulus sealing arrangement of FIG. 1 in a sealed position.
Figure 5:
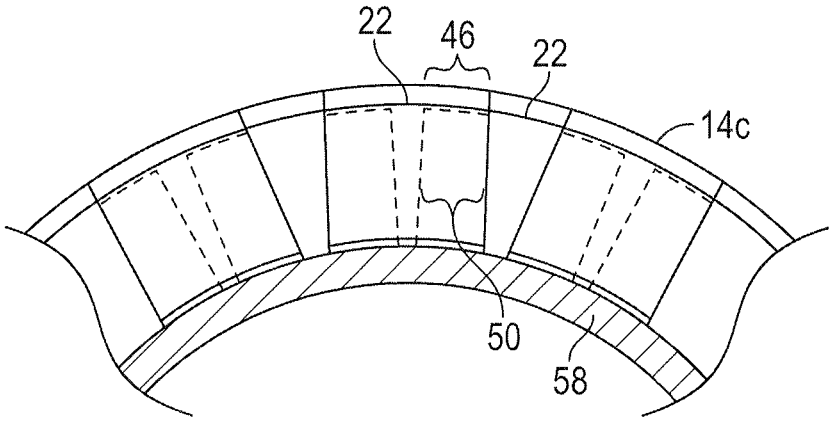
FIG. 5 depicts a partial cross sectional view of the annulus sealing arrangement of FIG. 3 taken at arrows 5-5.

A part 54 of the polymers 14A, 14B, 14C is positioned between the surfaces 34 and a mandrel 58 that defines an inner radial boundary of the annulus 18. As such, when the first radial dimension 26 of the polymers 14A, 14B, 14C increases the part 54 of the polymers 14A, 14B, 14C urges against the surfaces 34 in a direction to increase the acute angles 38. The acute angles 38 can increase until the plates 22 contact a structure 62 that defines the outer radial boundary of the annulus 18 thereby spanning the second radial dimension 30 of the annulus 18 and acting as a dam to prevent extrusion of the polymers 14A, 14B, 14C longitudinally past the plates 22. The acute angles 38 can increase to a full 90 degrees as shown in FIGS. 2 and 4. In some embodiments the plates 22 may be sized to effectively bridge the second radial dimension 30 when the acute angles 38 are at 90 degrees.

The polymers 14A, 14B, 14C can be made of a viscoelastic material such that it has both viscosity and elasticity to help is seal to both the mandrel 58 and the structure 62. The polymers 14A, 14B, 14C can be made to increase the first radial dimension 26 by different mechanisms regardless of the material they are made of. In one embodiment the annulus sealing arrangement 10 is longitudinally compressed to cause the polymers 14A, 14B, 14C to increase the first radial dimension 26. One or more supports 66A, 66B may be longitudinally movable along the mandrel 58 to longitudinally compress the polymers 14A, 14B, 14C. In the illustrated embodiment the support 66B has moved from its position shown in FIGS. 1 and 3 to its position shown in FIGS. 2 and 4. The movement of the support 66B longitudinally compresses the polymers 14A, 14B, 14C causing the part 54 to rotate the plates 22 increasing the acute angles 38 in the process. The increase in the first radial dimension 26 causes the polymers 14A, 14B, 14C to become radially sealingly engaged with both the structure 62 and the mandrel 58.

Alternatively, the polymers 14A, 14B, 14C can be made of a material that swells when exposed to a target environment. Such as an environment wherein the annulus sealing arrangement 10 will be employed; regardless of whether the environment is naturally occurring or is artificially created. Swelling of the polymers 14A, 14B, 14C causes the part 54 to urge against the surfaces 34 and increase the acute angles 38 and sealingly engage the polymers 14A, 14B, 14C to both the structure 62 and the mandrel 58. Regardless of whether the mechanism for increasing the first radial dimension 26 is due to longitudinal compression, material swelling or a combination of the two the effect of sealing and support for the polymers 14A, 14B, 14C by the plates 22 is substantially the same.

The annulus sealing arrangement 10 can be used in various industries including the carbon dioxide sequestration and hydrocarbon recovery industries. In the two named industries the arrangement 10 can be used to seal the annulus 18 that is in a borehole in an earth formation. In such an application the mandrel 58 can be one of a downhole tool, a drillstring, a liner or a casing, for example that forms the annulus 18 with the structure 62. The structure 62 can be one of a downhole tool, a drillstring, a liner, a casing or an open hole, for example. When used in these applications the arrangement 10 can be part of a treatment plug, packer, bridge plug, or frac plug, for example. To elaborate further the teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, and flow improvers, for example. Illustrative well operations include, but are not limited to, hydraulic fracturing, stimulation, tracer injection, cleaning, acidizing, steam injection, water flooding, and cementing, for example.

The specific application of the arrangement 10 can influence structural design and materials employed of the various components. In applications wherein a significant pressure differential may be generated across the arrangement 10 the plates 22 may be made of strong materials such as stainless steel, for example. It may also be beneficial to attach the plates 22 to one another. Such attachment could be via a cable 70 strung perimetrically through bores 74 (shown in FIG. 4 only) in all the plates 22 that define a row of plates 22, for example. Alternatively, a wire mesh (not shown) could be used to attach the plates 22 together. The plates 22 could also be attached by the polymers 14A, 14B, 14C themselves such as by being over molded therewithin, for example. In such a configuration there may be a layer 78 (shown in FIG. 3 only) of the material of the polymers 14A, 14B, 14C on a longitudinal side of the plates 22 that is opposite from where the majority of the polymers 14A, 14B, 14C is located. Although the surfaces 34 in the illustrated embodiment are facing the side of the plates 22 where the majority of the polymers 14A, 14B, 14C is located alternate embodiments could have this orientation reversed. And finally, although the embodiment illustrated includes three of the polymers 14A, 14B, 14C with a first ring 82A of a stiff material positioned between the polymers 14A and 14B, and a second ring 82B positioned between the polymers 14B and 14C, other embodiments could employ fewer than three of the polymers 14A, 14B, 14C include just one without inclusion of the rings 82A, 82B at all.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An annulus sealing arrangement, comprising:

at least one seal member positionable within an annulus, a first radial dimension of the at least one member being initially less than a second radial dimension defined by the annulus;

at least one second seal member distinct from and adjacent to the at least one seal member; and a plurality of individual plates separately embedded in the second seal member, the at least one second seal member in operable communication with the at least one seal member, the plurality of individual plates initially positioned with surfaces of the plurality of individual plates forming acute angles relative to an axis defined by the annulus, at least a first portion of each of the plurality of individual plates perimetrically overlapping a second portion of at least one other of the plurality of individual plates positioned perimetrically adjacent thereto, the annulus sealing arrangement being configured such that increases in the first radial dimension cause the acute angles to increase during deformation of the at least one second seal member.

2. The annulus sealing arrangement of claim 1, wherein one set of the plurality of individual plates is positioned near a longitudinal end of the at least one seal member.

3. The annulus sealing arrangement of claim 1, wherein increases in the acute angles cause the plurality of individual plates to span the second radial dimension defined by the annulus.

4. The annulus sealing arrangement of claim 3, wherein the acute angles increase to a 90 degree angle.

5. The annulus sealing arrangement of claim 1, further comprising at least one support positioned within the annulus on a longitudinal side of the plurality of individual plates opposite that of the at least one seal member.

6. The annulus sealing arrangement of claim 5, wherein the at least one support prevents the plurality of individual plates from moving longitudinally past the at least one support.

7. The annulus sealing arrangement of claim 1, further comprising at least one ring positioned in the annulus between the at least one seal member and the at least one second seal member.

8. The annulus sealing arrangement of claim 1, wherein the at least one seal member is configured to cause radial increases in the first radial dimension in response to being longitudinally compressed.

9. The annulus sealing arrangement of claim 1, wherein the at least one seal member is configured to cause radial increases in the first radial dimension in response to swelling of the at least one seal member.

10. The annulus sealing arrangement of claim 1, wherein at least some of the plurality of individual plates are attached to others of the plurality of individual plates.

11. The annulus sealing arrangement of claim 10, wherein the plurality of individual plates are perimetrically attached to others of the plurality of plates.

12. The annulus sealing arrangement of claim 1, wherein the acute angles are formed relative to surfaces of the plurality of individual plates facing toward a majority of the at least one seal member.

13. The annulus sealing arrangement of claim 1, wherein the plurality of individual plates are configured to radially fill the annulus to prevent the at least one seal member from extruding past the plurality of individual plates after the acute angles have increased.

14. The annulus sealing arrangement of claim 1, wherein the annulus sealing arrangement is part of a treatment plug, packer, bridge plug, or frac plug.

15. The annulus sealing arrangement of claim 1, wherein the plurality of individual plates are positioned in at least a first row and a second row, the first row being longitudinally adjacent to the second row and the plurality of individual plates in the first row being perimetrically offset relative to the plurality of individual plates in the second row.

16. The annulus sealing arrangement of claim 1, wherein part of the at least one seal member is positioned between the surfaces and a mandrel defining an inner radial boundary of the annulus.

17. The annulus sealing arrangement of claim 1, wherein the at least one seal member is a polymer.

18. A method of sealing an annulus, comprising:

radially increasing a dimension of a first seal member to span a radial dimension of the annulus;

sealing the annulus to flow past the first seal member;

deforming a second seal member thereby rotating a plurality of individual plates separately embedded in the second seal member and in operable communication with the seal member with the radial increasing of the first seal member;

preventing the plurality of individual plates from moving longitudinally away from the first seal member; and preventing extrusion of the first seal member through the annulus past the plurality of individual plates.

19. The method of sealing an annulus of claim 18, further comprising compressing the member between two sets of the plurality of individual plates.

20. The method of sealing an annulus of claim 18, further comprising swelling the first seal member to radially increase the dimension thereof.

21. The method of sealing an annulus of claim 18, further comprising increasing acute angles formed between surfaces of the plurality of individual plates and an axis of the annulus with the rotating of the plurality of individual plates.

22. The method of sealing an annulus of claim 18, further comprising perimetrically overlapping at least a portion of each of the plurality of individual plates with another of the plurality of individual plates.

23. The method of sealing an annulus of claim 18, further comprising:

diverting fluid with the sealing; and treating an environment within an earth formation with the diverted fluid.

* * * * *